US010720048B2

(12) United States Patent
Wu

(10) Patent No.: US 10,720,048 B2
(45) Date of Patent: Jul. 21, 2020

(54) INFRARED REMOTE CONTROL LEARNING METHOD AND DEVICE

(71) Applicant: SHENZHEN UNITIVELINK ELECTRONICS CO., LTD., Shenzhen, Guangdong (CN)

(72) Inventor: Tianji Wu, Guangdong (CN)

(73) Assignee: SHENZHEN UNITIVELINK ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 16/320,095

(22) PCT Filed: Jun. 9, 2017

(86) PCT No.: PCT/CN2017/087724
§ 371 (c)(1),
(2) Date: Jan. 23, 2019

(87) PCT Pub. No.: WO2018/040661
PCT Pub. Date: Mar. 8, 2018

(65) Prior Publication Data

US 2019/0266888 A1 Aug. 29, 2019

(30) Foreign Application Priority Data

Aug. 30, 2016 (CN) ..... 2016 1 0779287

(51) Int. Cl.
*G08C 23/04* (2006.01)

(52) U.S. Cl.
CPC ..... *G08C 23/04* (2013.01); *G08C 2201/20* (2013.01)

(58) Field of Classification Search
CPC ..... G08C 2201/20; G08C 23/04
See application file for complete search history.

(56) References Cited

U.S. PATENT DOCUMENTS

2003/0020645 A1* 1/2003 Akiyama ..... G08C 23/04 341/176
2004/0155809 A1* 8/2004 Eyer ..... G08C 23/04 341/176

FOREIGN PATENT DOCUMENTS

CN 102855744 A 1/2013
CN 103426292 A 12/2013

OTHER PUBLICATIONS

International Search Report of PCT Patent Application No. PCT/CN2017/087724 dated Aug. 30, 2017.

* cited by examiner

*Primary Examiner* — Sisay Yacob

(57) ABSTRACT

The present disclosure discloses an infrared remote control learning method, including: receiving an infrared signal transmitted by an infrared remote controller when a key of the infrared remote controller is operated; acquire corresponding infrared coded data according to the received infrared signal, and completing learning of the key, when the subsequent infrared coded data comprises infrared coded data identical to the first acquired infrared coded data, the subsequent infrared coded data being infrared coded data acquired after the first infrared coded data. The present disclosure also discloses an infrared remote control learning device. According to the present disclosure, all code values of each key of an infrared remote controller may be learned, so that the range learned by a mobile terminal may be expanded, realizing more accurate and complete learning of code value information of the original key.

8 Claims, 10 Drawing Sheets a b

INFRARED REMOTE CONTROL LEARNING METHOD AND DEVICE

FIELD

The present disclosure relates to the field of communication technology, and in particular, relates to an infrared remote control learning method and device.

BACKGROUND

Currently, infrared remote control is the most widely used means of communication and remote control, which can be applied to electrical appliances such as television, air conditioner, electric fans, set-top boxes, DVD, and so on. At present, the control of one entity infrared remote controller purchased from the market on electrical appliances is immutable, i.e. one entity infrared remote controller may only control one or several corresponding electric appliances. Due to its limited control range, the entity infrared remote controller cannot support users to control other new developed electric appliances, thus a learning function is developed, i.e., a terminal may acquire the functions of an infrared remote controller which is to be learned by learning different function keys of the infrared remote controller. Thereby the terminal may control the electric appliances that the infrared remote controller controls.

At present, mechanical remote controllers and mobile terminals with infrared functions, such as mobile phones and tablet computers, may learn various functions of keys of infrared remote controllers, making it unnecessary for users to change remote controllers frequently, and remotely controlling various electrical appliances via one terminal, which expands the control of the terminals, and makes it more convenient for users. However, when learning the functions of a key of an infrared remote controller, a mobile terminal samples the transmitted code information of a learned key for only once, but one key of some remote controllers may transmit different code values according to different frequencies of operation performed on the key. In this case, the mobile terminal may not truly and comprehensively learn all the code values of the key, which may cause failure of the mobile terminal in realizing all the functions of the key when remotely controlling electric appliances.

SUMMARY

The main purpose of the present disclosure is to provide an infrared remote control learning method and device, aiming at learning all code values of each key of the infrared remote controller, thereby expanding the learning range learned by a mobile terminal, and enabling the mobile terminal to learn the code value information of the original key more accurately and completely.

In order to achieve the above object, the present disclosure provides an infrared remote control learning method including: receiving an infrared signal transmitted by an infrared remote controller when a key of the infrared remote controller is operated; acquiring corresponding infrared coded data according to the received infrared signal; comparing every newly acquired subsequent infrared coded data with first acquired infrared coded data every time the subsequent infrared coded data is acquired; returning to the operation of receiving an infrared signal transmitted by an infrared remote controller when a key of the infrared remote controller is operated, when the two sets of infrared coded data are different; completing learning of the key, when the subsequent infrared coded data includes infrared coded data identical to the first acquired infrared coded data, the subsequent infrared coded data being infrared coded data acquired after the first infrared coded data;

and when the acquisition order of data in the infrared coded data is taken as a positive order, the operation of comparing every newly acquired subsequent infrared coded data with first acquired infrared coded data every time the subsequent infrared coded data is acquired includes:

compare the two sets of infrared coded data bit by bit based on the positive order which starts from the starting positions of the two sets of infrared coded data; if different data is detected during the comparison between the two sets of infrared coded data based on the positive order, respectively recording the positions of the detected different data in the two sets of infrared coded data as first positions, and comparing the two sets of infrared coded data bit by bit based on the reverse order which starts from the termination positions of the two sets of infrared coded data; if no different data is detected during the comparison between the two sets of infrared coded data based on the reverse order until the first position in one set of infrared coded data with fewer bits, recording the former one position, which is in one set of infrared coded data with more bits, and is previous to the position where the comparison based on the reverse order is completed, as a second position, and detecting to determine whether the data between the first position and the second position in the set of infrared coded data with more bits is cyclic data; if the data is cyclic data, determining that the two sets of infrared coded data are the same, otherwise determining that the two sets of infrared coded data are different; if different data is detected during the comparison between the two sets of infrared coded data based on the reverse order until the first position in the set of infrared coded data with fewer bits, determining that the two sets of infrared coded data are different; the operation of comparing the two sets of infrared coded data bit by bit based on the positive order which starts from the starting positions of the two sets of infrared coded data further includes: if no different data is detected during the comparison between the two sets of infrared coded data based on the reverse order, judging whether the lengths of the two sets of infrared coded data are the same; if the lengths of the two sets of infrared coded data are the same, determining that the two sets of infrared coded data are the same; if the lengths of the two sets of infrared coded data are not the same, recording one latter position, which is in the set of infrared coded data with more bits, and is subsequent to the position where the comparison based on the positive order is completed, as the first position, and recording the termination position in the set of infrared coded data with more bits as the second position, and detecting to determine whether the data between the first position and the second position in the set of infrared coded data with more bits is cyclic data; if the data is cyclic data, determining that the two sets of infrared coded data are the same, otherwise determining that the two sets of infrared coded data are different.

In addition, in order to achieve the above object, the present disclosure also provides an infrared remote control learning method including: receiving an infrared signal transmitted by an infrared remote controller when a key of the infrared remote controller is operated; acquiring corresponding infrared coded data according to the received infrared signal; completing learning of the key, when the subsequent infrared coded data includes infrared coded data identical to the first acquired infrared coded data, the subsequent infrared coded data being infrared coded data acquired after the first infrared coded data.

In addition, in order to achieve the above object, the present disclosure also provides an infrared remote control learning device including: a receiving module, configured to receive the infrared signal transmitted by an infrared remote controller when a key of the infrared remote controller is operated, a first acquiring module, configured to acquire corresponding infrared coded data according to the received infrared signal; a completing module, configured to complete learning of the key, when the subsequent infrared coded data includes infrared coded data identical to the first acquired infrared coded data, the subsequent infrared coded data being infrared coded data acquired after the first infrared coded data.

According to the present disclosure, at least two times of press-release operation is performed on each key of an infrared remote controller, in the process of each press-release operation during the learning of the transmitted code information of the key of the infrared remote controller by a mobile terminal. The mobile terminal acquires the corresponding infrared code data according to the received infrared signal. When the subsequent infrared coded data includes infrared coded data identical to the first acquired infrared coded data, it is indicated that code values of the key have been cyclic, and all values of the key have been learned, at this point, complete the learning of the key to prevent the learning about the key from being untruthful and incomplete due to that the terminal samples the transmitted code information of the learned key for only once. According to the present disclosure, all code values of each key of an infrared remote controller may be learned, so that the range learned by a mobile terminal may be expanded, realizing more accurate and complete learning of code value information of the original key.

The implementation, functional features and advantages of the present disclosure will be further described with reference to the drawings in combination with the embodiments.

DETAILED DESCRIPTION OF THE EMBODIMENTS

In order to make the purpose, technical scheme and advantages of the.

It should be understood that the specific embodiments described herein are only for the purpose of explaining the present disclosure and are not intended to limit the present disclosure.

The present disclosure provides an infrared remote control learning method.

Figure 1:
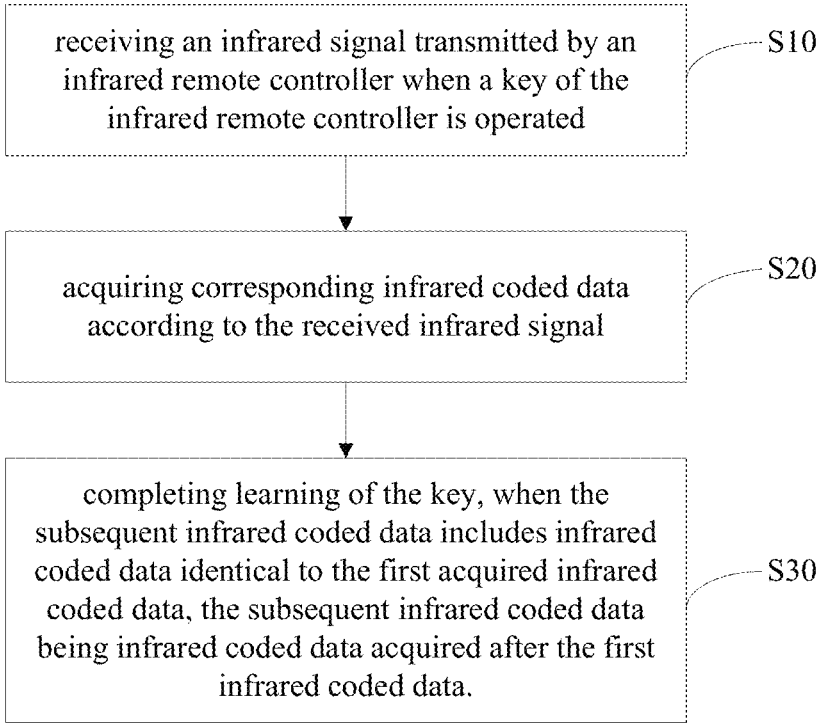
FIG. 1 is a flow chart of an infrared remote control learning method in the first embodiment according to the present disclosure.

Referring to FIG. 1, FIG. 1 is a flow chart of an infrared remote control learning method in the first embodiment according to the present disclosure. The method includes the following operations:

operation S10: receiving an infrared signal transmitted by an infrared remote controller when a key of the infrared remote controller is operated;

In this embodiment, a mobile terminal receives the infrared signal transmitted when a certain key of the infrared remote controller is operated, and the operation process performed on the key refers to the complete process of press-release operation performed on the key for once. In this embodiment, the mobile terminal may include smart phones, tablet computers, and other devices with infrared remote control learning function, and devices such as smart phones and tablet computers may configure their own infrared connectors, or may connect foreign devices equipped with infrared connectors in ways such as through Bluetooth, wireless network or USB, to realize the infrared remote control learning. The infrared remote controller may include remote controller of televisions, set-top boxes, DVD, air conditioners and other electrical appliances, and may be flexibly selected in specific implementation.

Figure 2:
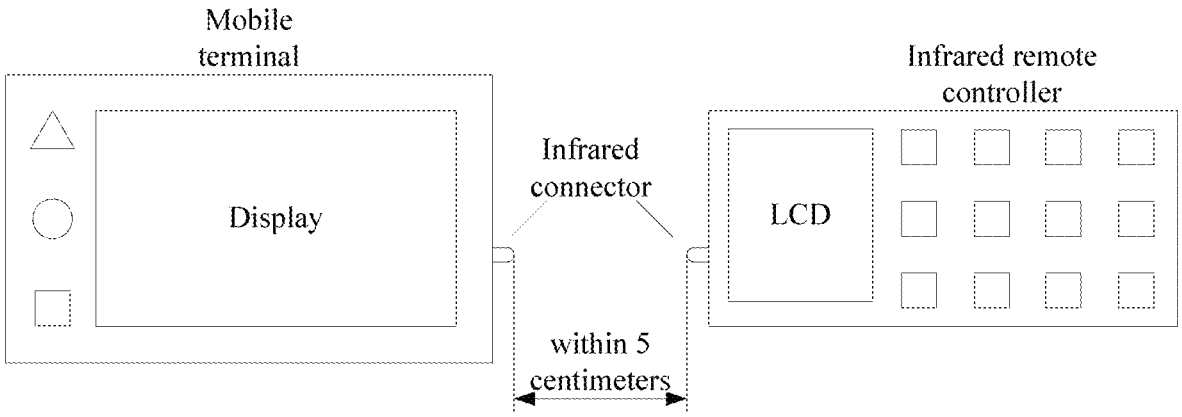
FIG. 2 is a schematic diagram of an application scenario of the infrared remote control learning method according to the present disclosure.

Specifically, referring to FIG. 2, FIG. 2 is a schematic diagram of an application scenario of the infrared remote control learning method according to the present disclosure. In this embodiment, the mobile terminal may enter the learning state by enabling an infrared remote control learning APP or other infrared signal learning program. After the mobile terminal enters the learning state, the user may aim the front end of the learned infrared remote controller at the front end of the mobile terminal, and make the distance between the infrared connectors within 5 centimeters to avoid interference in the transmission and reception of infrared signals. When the press-release operation performed by a user to a key of an infrared remote controller for once, the corresponding generated infrared signal is transmitted to the mobile terminal via an infrared transmitter, after being modulated. Since some keys may have different code values corresponding to different pressing times, it is necessary to learn multiple times of transmitted code information of each key. For example, when the key corresponds to only one code value, the code value may cycle under the situation that only two times of press-release operation performed on the key are needed. When the key corresponds to more than one code value, the press-release operation performed on the key performed by a user may be more than two times. Specifically, if one key is continuously learned for N times before cycling, it is indicated that the key has N−1 code values. Therefore, it may be understood that at least two times of press-release operation to each key of an infrared remote controller are needed to realize the accurate and complete learning of transmitted code value information of the original key by a mobile terminal.

Operation S20, acquiring corresponding infrared coded data according to the received infrared signal.

In this embodiment, after receiving the infrared signal transmitted by the infrared remote controller, the mobile terminal acquires corresponding infrared coded data according to the received infrared signal;

The transmission of the infrared signal is to superimpose carrier and envelope signal. After being received by the mobile terminal, the infrared signal is amplified, shaped and filtered by the operational amplifier in the demodulation module, and then is input to the carrier-envelope timer. The hardware circuit may separate the carrier from the envelope signal, the envelope signal is a combination of different high levels and low level, which represents different coded information. After the infrared signal is demodulated by the demodulation module, corresponding infrared coded data may be acquired, and the infrared coded data is a set of continuous time values of high/low levels, such as 9 ms, 4.5 ms, 560 μs, 560 μs, 1690 μs, or 50 ms.

In this embodiment, after receiving the infrared signal, the mobile terminal processes the infrared signal to acquire the level information of the infrared signal, and then acquires the corresponding infrared coded data according to the level information. In order to simplify the whole hardware circuit, the mobile terminal integrates a dedicated ASIC/MCU/FPGA chip into the main control CPU, and the chip is used to complete the modulation and demodulation of infrared signals and the processing of coded information. Of course, the mobile terminal may not integrate the chip into the main control CPU, for example, the chip may be arranged outside the main control CPU, and exchange information with the main control CPU via the UART/SPI/I2C interface, which may be flexibly arranged according to the actual situation. After the mobile terminal receives the infrared signal transmitted by the infrared remote controller, the infrared signal is demodulated, amplified, shaped, filtered and so on through a special circuit in the CPU to acquire the level information of the infrared signal, and then the time value corresponding to each high/low level is acquired to acquire a set of infrared coded data. After acquiring the infrared coded data, the mobile terminal stores the infrared coded data in a corresponding storage area.

Operation S30, completing learning of the key, when the subsequent infrared coded data includes infrared coded data identical to the first acquired infrared coded data, the subsequent infrared coded data being infrared coded data acquired after the first infrared coded data.

In this embodiment, after the mobile terminal enters the learning state, at least two times of press-release operation are performed on each key of the infrared remote controller when the mobile terminal is learning the transmitted code information of the key of the infrared remote controller. In each press-release operation process, the mobile terminal acquires corresponding infrared code data according to the received infrared signal. In this embodiment, the infrared code data acquired after the first time is defined as subsequent infrared code data. When the subsequent infrared coded data includes infrared coded data identical to the first acquired infrared coded data, it is indicated that code values of the key have been cyclic, and all values of the key have been learned. At this time, the mobile terminal ends the learning of the key, and enters the learning process of another key. If the subsequent infrared coded data is different from the infrared coded data acquired for the first time, repeat the press-release operation performed on the key until the code value of the key is cycled, so as to avoid untruthful and incomplete learning of the learned key due to that the terminal samples the transmitted code information of the learned key for only once. According to the embodiment, all code values of each key of the infrared remote controller may be learned, so that the learning range of the mobile terminal may be expanded, which make the mobile terminal learn the code value information of the original key more accurately and completely.

Figure 3:
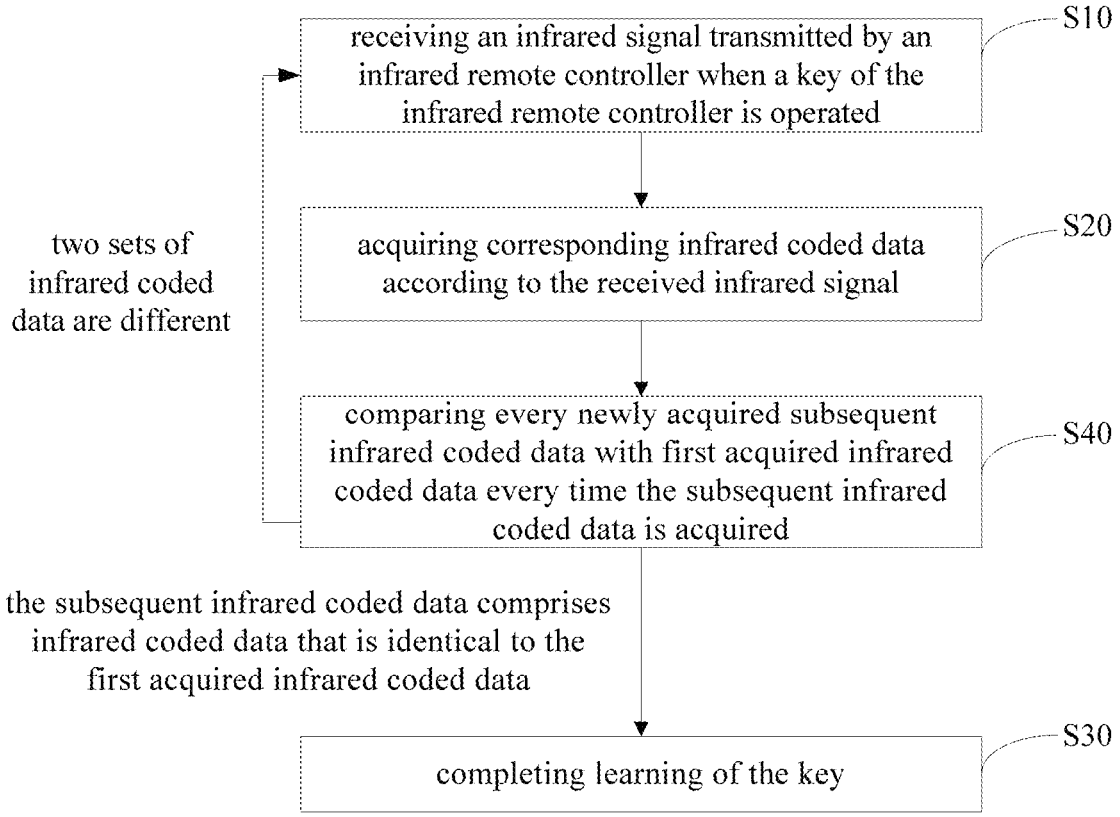
FIG. 3 is a flow chart of the infrared remote control learning method in the second embodiment according to the present disclosure.

Further, referring to FIG. 3, FIG. 3 is a flow chart of the infrared remote control learning method in the second embodiment according to the present disclosure. Based on the above embodiment shown in FIG. 1, before operation S30, the method further includes:

operation S40, comparing every newly acquired subsequent infrared coded data with first acquired infrared coded data every time the subsequent infrared coded data is acquired.

Return to the operation S10 of receiving an infrared signal transmitted by an infrared remote controller when a key of the infrared remote controller is operated, when the two sets of infrared coded data are different.

In this embodiment, since the times of the press-release operation performed on the key of the infrared remote controller is more than or equal to 2, the mobile terminal may compare the infrared code data acquired each time with the infrared code data acquired for the first time to determine whether the code value of the key has been learned in full. The mobile terminal records the infrared coded data every time the press-release operation is performed on the learned key of the infrared remote controller. After the press-release operation to key for the first time, the mobile terminal acquires subsequent infrared coded data every time the press-release operation is performed on the key. The mobile terminal may compare the newly acquired subsequent infrared coded data with the first acquired infrared coded data every time the subsequent infrared coded data is acquired. When the newly acquired subsequent infrared coded data, i.e. the current infrared coded data, is different from the first acquired infrared coded data, it is indicated that the code value of the key has not been fully learned. In this condition, returns to the operation of receiving an infrared signal transmitted by an infrared remote controller when a key of the infrared remote controller is operated, i.e. the user repeats the press-release operation performed on the key until the code value of the key is cycled.

Further, comparing two sets of infrared coded data by a mobile terminal is comparing time values of the high/low levels in the corresponding positions of the infrared coded data. In the actual comparison, errors in a normal range are allowed, that is, if the time values of two levels are within the normal error range, the two levels may be considered equal, and the normal error range is 3%-10%, of course the range may also be expanded according to the actual situation, such as 3%-15%. In addition, due to the existence of carrier, it is also possible that the time values of the high/low levels of two pieces of data differ by 1 to 2 carrier periods. If the time difference between the two data is within the allowable range of the error of the carrier, the two data can be considered equal, otherwise they do not differ. Therefore, the infrared signal with carrier wave may have time value error and period error, that is, if the level time value of the infrared data with carrier wave is within a normal error range, and the period error is also within a normal period error range, and it may also be determined that the two infrared data are equal.

It should be noted that when newly acquired subsequent infrared coded data is different from first acquired infrared coded data, the mobile terminal may remind the user to perform the press-release operation on the key for once again by voice. Of course, the mobile terminal may also remind the user without voice, such as by text reminding or vibration reminding, which may be flexibly set according to the actual needs in the specific implementation. When newly acquired subsequent infrared coded data is the same as first acquired infrared coded data, the mobile terminal may remind user in the same way that the key has been learned or to enter learning of another key.

Figure 4:
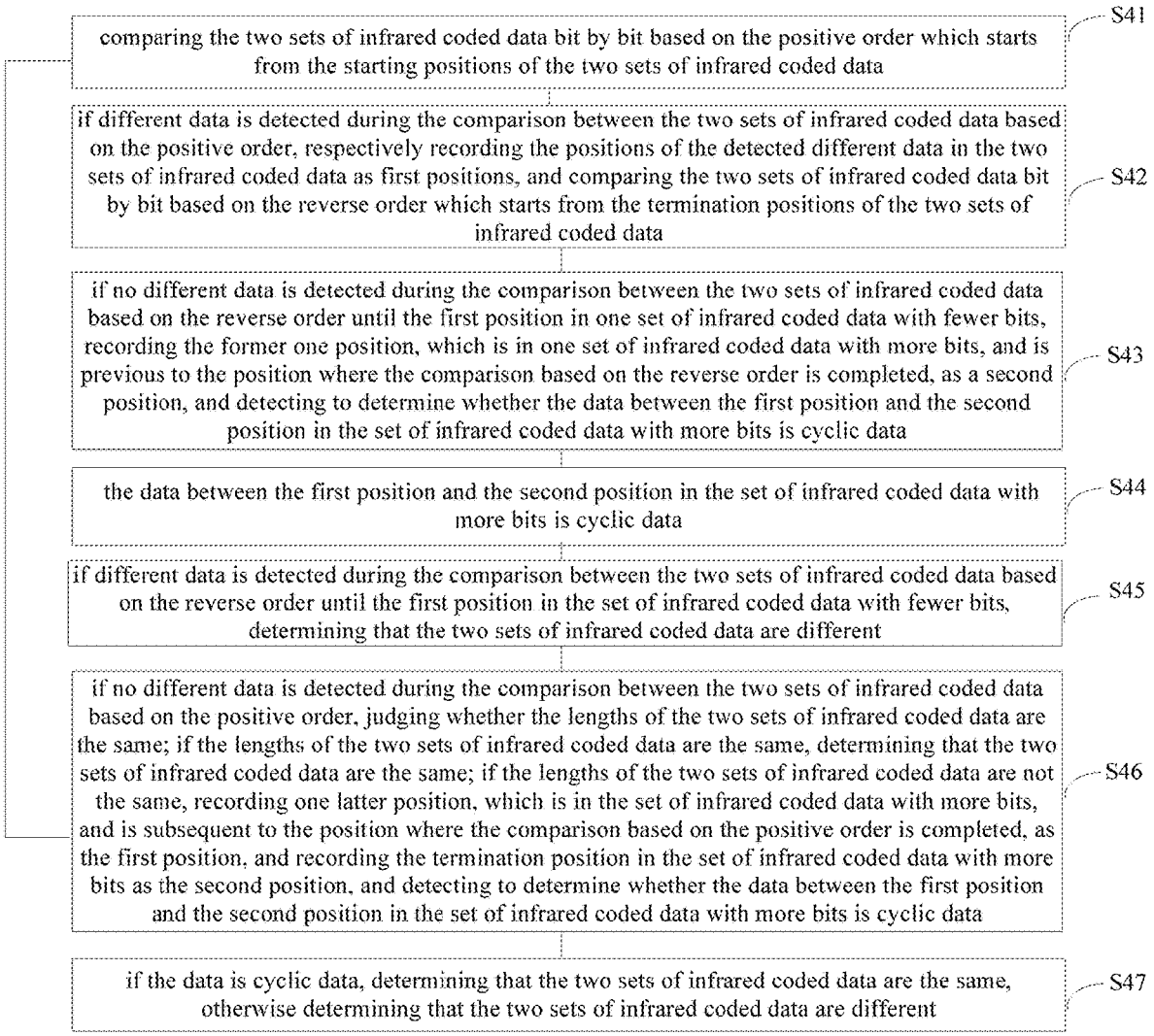
FIG. 4 is a detailed flow chart of comparing the newly acquired subsequent infrared coded data with the first acquired infrared coded data every time subsequent infrared coded data is acquired in FIG. 3.

Further, referring to FIG. 4, FIG. 4 is a detailed flow chart of comparing the newly acquired subsequent infrared coded data with the first acquired infrared coded data every time subsequent infrared coded data is acquired in FIG. 3. Based on the above embodiment shown in FIG. 3, taking the acquisition order of data in the infrared encoded data as a positive order, operation S40 may include:

operation S41, compare the two sets of infrared coded data bit by bit based on the positive order which starts from the starting positions of the two sets of infrared coded data;

operation S42, if different data is detected during the comparison between the two sets of infrared coded data based on the positive order, respectively recording the positions of the detected different data in the two sets of infrared coded data as first positions, and comparing the two sets of infrared coded data bit by bit based on the reverse order which starts from the termination positions of the two sets of infrared coded data;

operation S43, if no different data is detected during the comparison between the two sets of infrared coded data based on the reverse order until the first position in one set of infrared coded data with fewer bits, recording the former one position, which is in one set of infrared coded data with more bits, and is previous to the position where the comparison based on the reverse order is completed, as a second position, and detecting to determine whether the data between the first position and the second position in the set of infrared coded data with more bits is cyclic data;

operation S44, if the data between the first position and the second position in a set of infrared coded data with more bits is cyclic data, it is determined that the two sets of infrared coded data are the same, otherwise determining that the two sets of infrared coded data are different;

operation S45, if different data is detected during the comparison between the two sets of infrared coded data based on the reverse order until the first position in the set of infrared coded data with fewer bits, determining that the two sets of infrared coded data are different.

operation S46, judge whether the lengths of the two sets of infrared coded data are the same, if no different data is detected during the comparison between the two sets of infrared coded data based on the positive order; if the lengths of the two sets of infrared coded data are the same, determining that the two sets of infrared coded data are the same; if the lengths of the two sets of infrared coded data are not the same, recording one latter position, which is in the set of infrared coded data with more bits, and is subsequent to the position where the comparison based on the positive order is completed, as the first position, and recording the termination position in the set of infrared coded data with more bits as the second position, and detecting to determine whether the data between the first position and the second position in the set of infrared coded data with more bits is cyclic data;

operation S47, if the data is cyclic, determining that the two sets of infrared coded data are the same, otherwise determining that the two sets of infrared coded data are different.

In this embodiment, the acquisition order of data in the infrared encoded data is taken as the positive order, and the order opposite to the acquisition order of data in the infrared encoded data is the reverse order.

In this embodiment, two sets of the infrared coded data are compared bit by bit based on the positive order, starting from the starting positions of the two sets. The bit-by-bit comparison refers to that each level signal in the infrared coded data is compared one by one.

The comparison results include two cases:

A, different data are detected during the comparison between the two sets of infrared coded data based on the reverse order, in this condition, respectively record the positions of the different data detected in the two sets of infrared coded data as the first positions, that is, one first position is respectively recorded in the two sets of infrared coded data. Then comparing the two sets of infrared coded data bit by bit based on the reverse order starting from the ending positions of the two sets;

B, no different data is detected during the comparison between the two sets of infrared coded data based on the reverse order, in this condition, judge whether the lengths of the two sets of infrared coded data are the same; if the lengths are the same, determine that the two sets of infrared coded data are the same; if the lengths are not the same, record one latter position in the set of infrared coded data with more bits as the first position, which is after one completing position in the comparison based on the reverse order, and recording the termination position in the set of infrared coded data with more bits as the second position, and detecting to determine whether the data between the first position and the second position in the set of infrared coded data with more bits is cyclic data;

the comparison based on the reverse order bit by bit in case A includes two results: A1 and A2, A1: different data is detected during the comparison between the two sets of infrared coded data based on the reverse order until the first position in the set of infrared coded data with fewer bits, which indicates that the two sets of infrared coded data are different.

A2: no different data is detected during the comparison between the two sets of infrared coded data until the first position based on the reverse order, that is, the data in the first position of the set of infrared code data with fewer bit among the two sets may be compared for twice, in this condition, record the former one position in one set of infrared coded data with more bits as a second position, which is before one completing position in the comparison based on the reverse order, and detecting to determine whether the data between the first position and the second position in the set of infrared coded data with more bits is cyclic data; if the data is cyclic data, determining that the two sets of infrared coded data are the same, otherwise determining that the two sets of infrared coded data are different;

according to case B, the results of the detection to determine whether the data between the first position and the second position in the set of infrared coded data with more bits is circular data also includes two cases: b1 and b2. b1: if the data is cyclic data, determine that the two sets of infrared coded data are the same, otherwise determine that the two sets of infrared coded data are different.

In addition, it may also be judged in other ways, for example, divide the two sets of infrared coded data into two cases: the same length and the different length. When the length of newly acquired subsequent infrared coded data is the same as that of the first acquired infrared coded data, it is only necessary to compare the two sets of infrared coded data bit by bit to determine whether the two sets of infrared coded data are the same or not. If each bit of the two sets of infrared coded data are correspondingly the same, it is determined that the two sets of infrared coded data are the same; if there is at least one different bit in the two sets of infrared coded data, it is determined that the two sets of infrared coded data are different.

At this time, for convenience of understanding, according to the embodiment, the data generated by different operation performed on the key may be divided into a prefix, a loop code, and a post code, the loop code is the code repeatedly generated when the key is pressed down, and the post code is the code generated after the key is released, and all codes except the loop code and the post code are the prefix. When pressing operation is performed on the key for once, the infrared coded data may include at least one of a prefix, a cyclic code, and a post code.

Since each time when the key is pressed under the two operations is uncertain, the cycle times of the cyclic data in the two sets of infrared coded data may be different, which may result in different numbers of bits of the cyclic data. Due to the existence of cyclic data, there may be a case where the prefixes and the post codes of the two sets of infrared coded data are the same, but the numbers of bits of the cyclic data are different. In this case, the two sets of infrared coded data may also be considered the same.

When the numbers of bits of the two sets of infrared coded data are different, the two sets of infrared coded data may be the same key value only when contain cyclic data. In this case, infrared coded data has four kinds of combinations: prefix, cyclic code and post code, prefix and cyclic code, cyclic code and post code, and cyclic code.

In this case, the judgment process of the intelligent terminal may be similar to the embodiment shown in FIG. 4, i.e., including the processes of performing a comparison based on the reverse order, then performing a comparison based on the reverse order, and judging cyclic data, which will not be described here.

Further, the process of judging whether it is cyclic data may include: assuming that the starting data of one set with more bits among the two sets of infrared coded data is A1, the first position and the second position in the comparison mentioned above are respectively recorded as Am and An, it is noted that $1<m<n$. First step: to find the data equal to An by the reverse order comparison in a range of A1 to An-1, that is, An is respectively compared with An-1, An-2, . . . A1. If there is no data equal to An, the data between Am and An are not circular data; If a data equal to An is found, which is assumed as Ax, then entering a second step: to take each data between Am and An-1 to compare with the data before Ax, that is, comparing An-1 with Ax-1, An-2 with Ax-2, and so on, totally the comparison is performed for n-m times. If all results of the comparison processes are that the data compared are equal, the data between Am and An is circular data. Otherwise, return to the first step, the range to look for the data equal to An is narrowed to from A1 to Ax-1. It may be seen that if the above two steps are repeated, the range from A1 to Ax-1 may be smaller and smaller, that is, Ax-1 may be closer and closer to A1.

Figure 5:
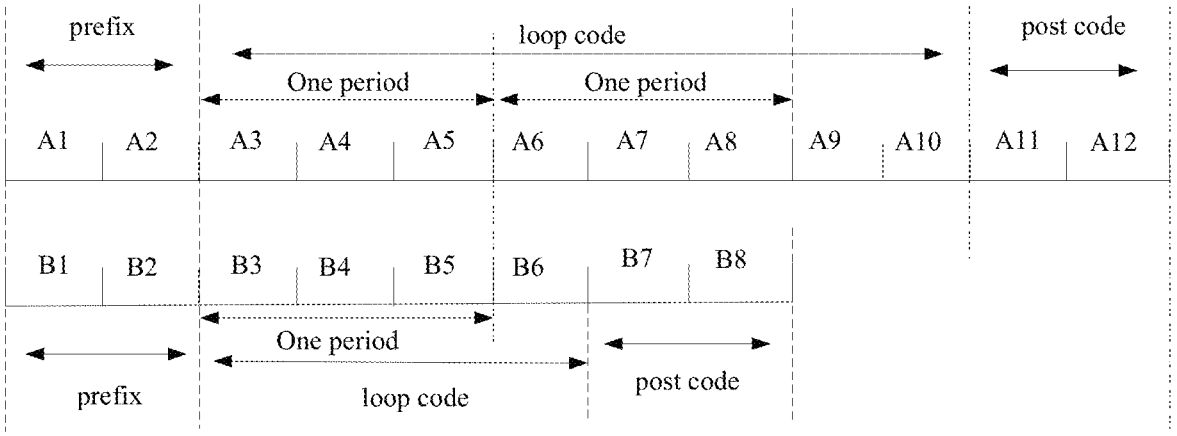
FIG. 5 is a schematic diagram of a comparison scenario of two sets of infrared coded data.
Figure 5:
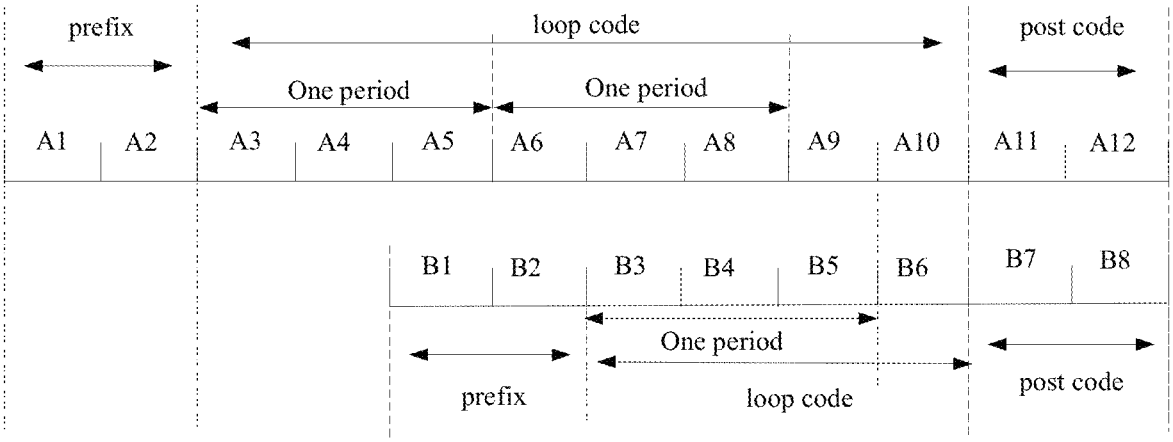
Figure 6:
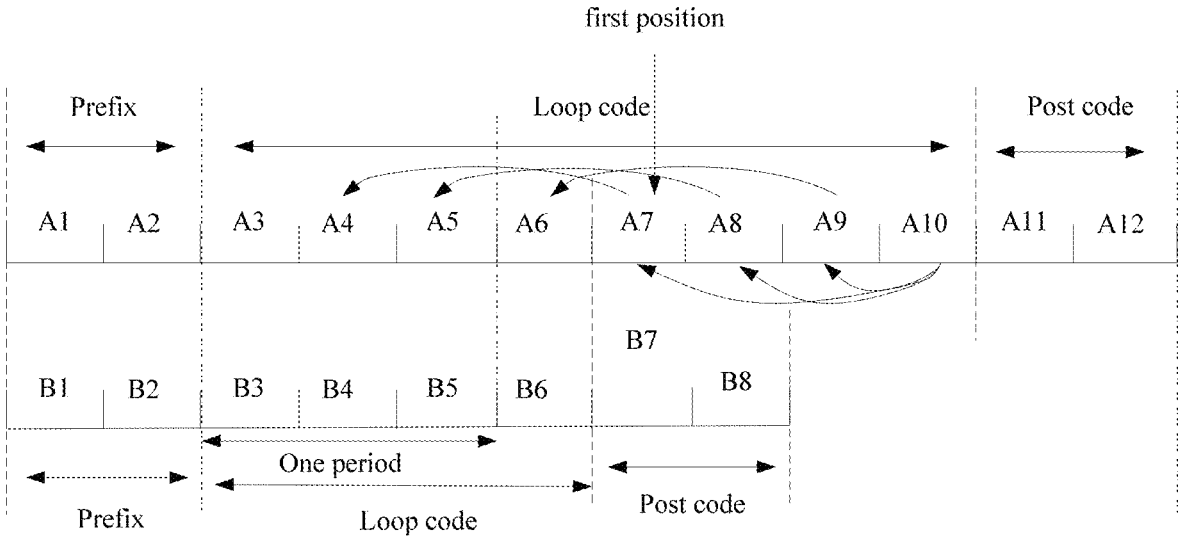
FIG. 6 is a schematic diagram of another comparison scenario of two sets of infrared coded data.

Further, referring to FIG. 5 and FIG. 6, FIG. 5 is a schematic diagram of a comparison scenario of two sets of infrared coded data, and FIG. 6 is a schematic diagram of a comparison scenario of the cyclic data in FIG. 5.

The infrared coded data in the comparison scene includes a prefix, a cyclic code, and a post code. In the figure, A1, A2 to A12 represent the data of one set of infrared coded data with more bits, and B1, B2 to B8 represent the data of one set of infrared coded data with fewer bits. First, sequentially compare A1 with B1, A2 with B2, and so on, until compare A7 with B7 to result different, in this case, record A7 and B7 as the first positions, and then compare the two sets of infrared coded data based on the reverse order. That is, sequentially compare A12 with B8, A11 with B7 (comparing to the first position), and recording the former one position in one set of infrared coded data with more bits as a second position, i.e. A10, which is before one completing position in the comparison based on the reverse order, and detecting to determine whether the data between the A7 and A10 is cyclic data. Specifically, if the time data values within a cycle period are not equal, i.e. A3 is not equal to A4, and A4 is not equal to A5. Then the first operation is as follows: first compare A10 with A9, resulting equal; then compare A10 with A8, resulting different; compare A10 with A7, resulting equal. Then proceed to the second operation as follows: compare A9 with A6, resulting equal; compare A8 with A5, resulting equal compare A7 with A4, resulting equal. So far, it is indicated that the data between A7 and A10 is circular data. If there is equal time data values in a cycle period, such as A4=A5, then the first operation is as follows: first compare A10 with A9, resulting equal; then compare A10 with A8, resulting equal. Then proceed to the second operation: compare A9 to A7, resulting different. At this point, return to the first operation: compare A10 with the former one before A8, i.e. A7, resulting equal. Then proceed to the second operation as follows: compare A9 with A6, resulting equal; compare A8 with A5, resulting equal compare A7 with A4, resulting equal. So far, it is also indicated that the data between A7 and A10 is circular data.

In summary, the first way of comparison is that no matter what kind or combinations of code values the infrared coded data is, dividing the combination is easy to understand the algorithm in the present disclosure, the positive order comparison is mainly aimed at the prefix, the reverse order comparison is mainly aimed at the post code, and the self comparison, that is, the process of judging the cyclic data is aimed at the cyclic code. The first way is to judge in the condition that any two sets of data acquired are taken as a combination of prefix+cyclic code+post code. Therefore, the same algorithm is used to first compare the data based on the positive order, and then based on the reverse order, and at last to perform self-comparison. Some combinations may judge to obtain the result without completing the complete comparison processes. Only the combination of prefix+cyclic code+post code may go through the complete comparison processes.

Figure 7:
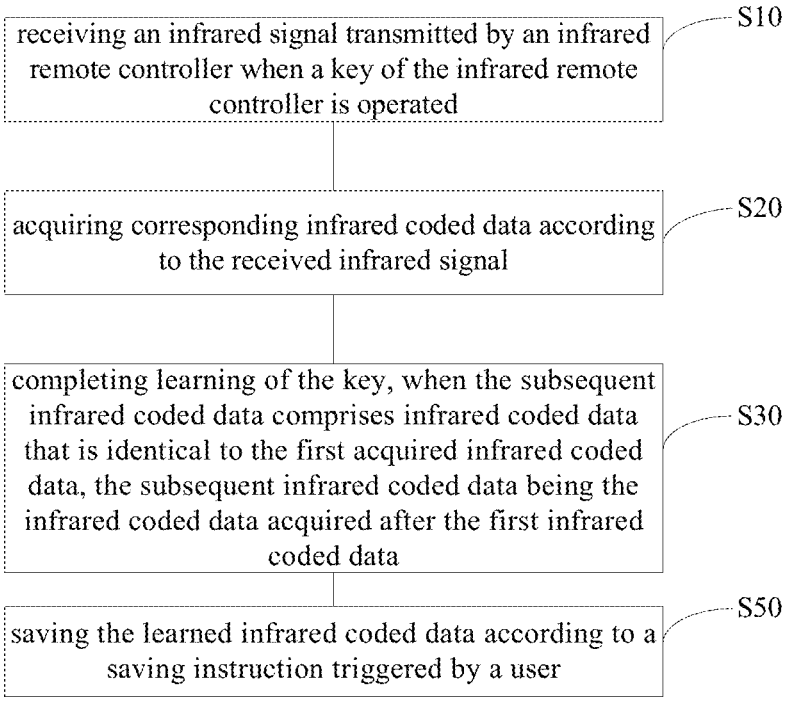
FIG. 7 is a flowchart of the infrared remote control learning method in the third embodiment according to the present disclosure.

Further, referring to FIG. 7, FIG. 7 is a flow chart of the infrared remote control learning method in the third embodiment according to the present disclosure. Based on the above embodiment shown in FIG. 1, after operation S30, the method may further include:

operation S50, saving the learned infrared coded data according to saving instruction triggered by a user.

In this embodiment, during the learning process of the mobile terminal, a user may trigger a save instruction on the display interface to save the learned code data. In specific implementation, in order to make the functions of each key learned, the user may only trigger a save instruction after all the functions of the key have been learned, that is, all the infrared code data of the key have been learned, and in this case, the infrared code data saved is the saved infrared code data corresponding to all the functions of each key.

Further, after completing the learning of all the learned keys of the infrared remote controller and uploading them to a server, professionals may restore the data to corresponding high and low level waves through professional software, and then extract relevant information by an operator, such as the infrared coding format, carrier, user code (i.e. key value) and customer code (i.e. electric remote controller of one specification corresponds to one customer code, of course, some electric remote controller do not have customer code) and so on, and save the information in the database of the network server.

It may be specially noted that each remote controller has two types of information: code value and panel key display, and remote controller of air conditioner also has LCD display information. Both the panel key display information and LCD display information need to be photographed and measured by an operator to make corresponding interface files, and then put them into the database together. Other users may completely reproduce all the functions of the original remote controller on an intelligent terminal by downloading the code values, and the panel key display and LCD display information from the database of the server.

In this embodiment, the mobile terminal receives the infrared signal transmitted when the key of the infrared remote controller is operated, acquire corresponding infrared coded data according to the received infrared signal, and complete learning of the key, when the subsequent infrared coded data includes infrared coded data identical to the first acquired infrared coded data, the subsequent infrared coded data being infrared coded data acquired after the first infrared coded data, and save the learned infrared coded data according to saving instruction triggered by a user. Through the above method, the mobile terminal in this embodiment may share the learned coding information of various infrared remote controllers, thus users does not need to relearn the functions of the infrared remote controllers when using other mobile terminals, and all they need is just to download corresponding data files from the server, which is convenient and improves use experience.

Figure 8:
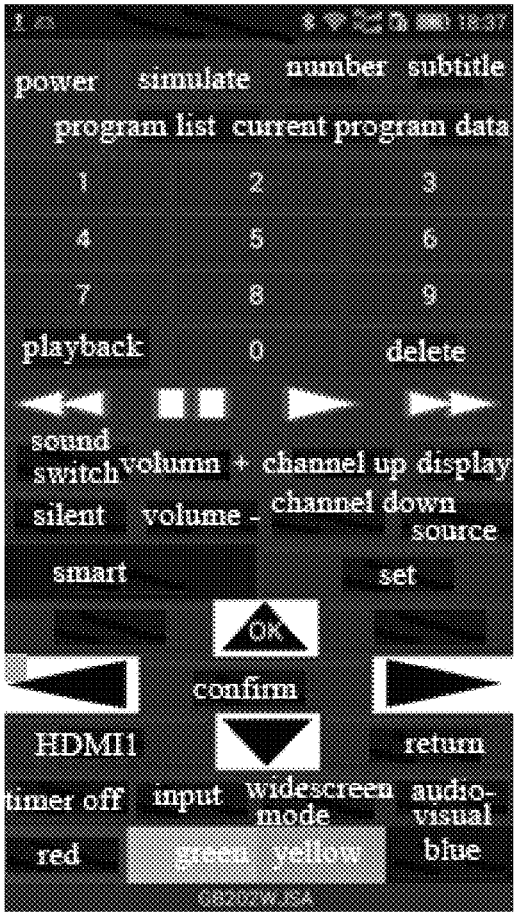
FIG. 8 is a schematic diagram of a manufacturing interface of a remote controller in some embodiments according to the present disclosure.
Figure 9:
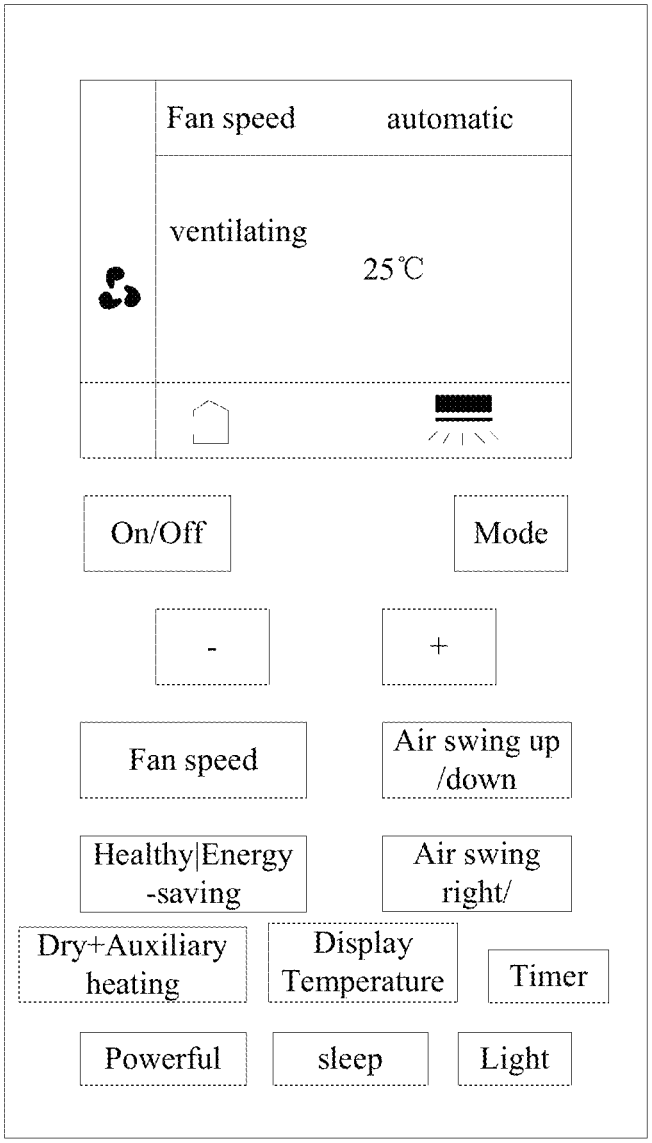
FIG. 9 is a schematic diagram of an interface of an air conditioner remote controller in some embodiments according to the present disclosure.
Figure 10:
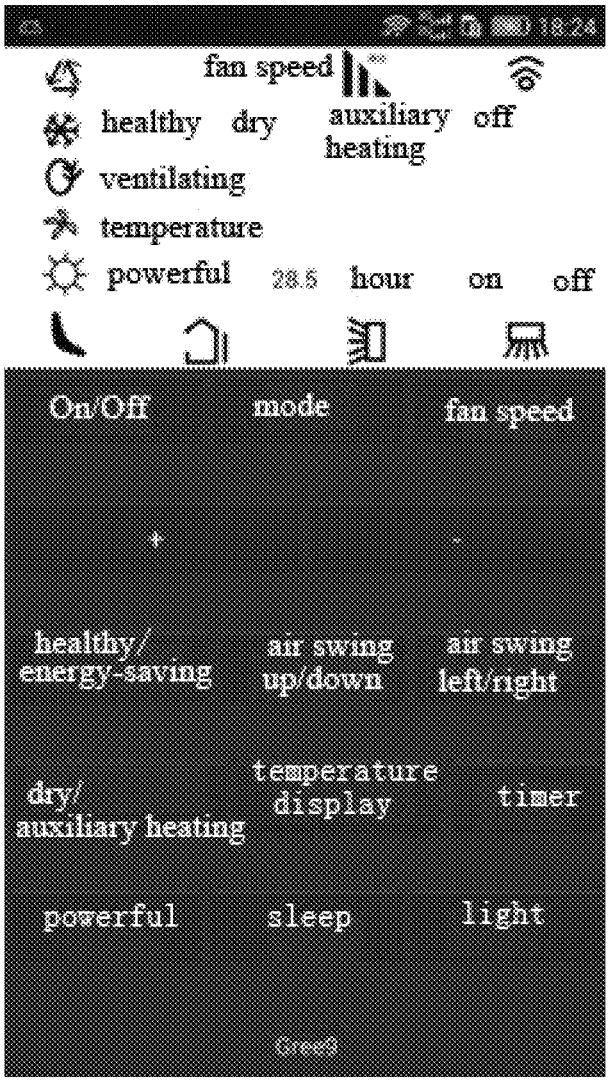
FIG. 10 is a schematic diagram of a manufacturing interface of an air conditioner remote controller in some embodiments according to the present disclosure.

Further, the actual operation process may include the operation of taking pictures of a remote controller, a piece of controlled apparatus, and an operating manual by a user first. The advantage of taking picture of the controlled apparatus is that the model of the controlled apparatus controlled by the remote controller may be learned via the picture based on image recognition technology, and the picture of the remote controller may remotely control common television. After being taken, the pictures are transmitted to a professional through mail or network, and the professional may make a corresponding interface to be displayed on an intelligent terminal according to the picture, as shown in FIG. 8, and upload the interface to the database in a network server, so that the user may download the interface from the network server through the network, then the interface and the method in the above embodiments of the present disclosure may be used to learn an infrared remote controller. Specifically, the process of using the interface to learn an infrared remote controller includes the operation made on a corresponding physical key, when a user sees a key flashing or highlighting on the interface. After all operations are completed, the software may automatically upload files of infrared waveform data acquired by learning all key values to the network server. Professionals may use special software to open the waveform data file for analysis, and then put the sorted relevant information into the database of the network server. In particular, since the air conditioner remote controller also includes an LCD display interface, as shown in FIG. 9, user also need is to record the LCD display content synchronously when learning each key to completely record the change process of the LCD display interface during the operation. In addition, air conditioner remote controllers may also achieve different functions due to different working modes, such as some air conditioners are not temperature-adjustable in automatic mode. Therefore, professionals may design an actual value table according to product operating manuals and remote controller picture so that users may fill in the table while operating the physical remote controller, thus finding out the logical relationship of the remote controller completely. This method may be difficult for ordinary users to implement. If it is not possible for ordinary users to implement the method, the learning operation may be completed by providing the physical remote controller to a professional. The interface of the air conditioner remote controller presented on the mobile terminal may be as shown in FIG. 10.

The present disclosure also provides an infrared remote control learning device.

The infrared remote control learning device of the present disclosure includes a receiving module, configured to receive the infrared signal transmitted by an infrared remote controller when a key of the infrared remote controller is operated; a first acquiring module, configured to acquire corresponding infrared coded data according to the received infrared signal; a completing module, configured to complete learning of the key, when the subsequent infrared coded data includes infrared coded data identical to the first acquired infrared coded data, the subsequent infrared coded data being infrared coded data acquired after the first infrared coded data.

Further, the infrared remote control learning device of the present disclosure further includes a comparing module, configured to compare every newly acquired subsequent infrared coded data with first acquired infrared coded data every time the subsequent infrared coded data is acquired; the receiving module is further configured to receive an infrared signal transmitted by an infrared remote controller when a key of the infrared remote controller is operated, when the two sets of infrared coded data are different.

Further, the comparing module is also configured to compare the two sets of infrared coded data bit by bit when the numbers of bits of the two sets are the same; if each bit of the two sets of infrared coded data are correspondingly the same, it is determined that the two sets of infrared coded data are the same; otherwise, determine that the two sets of infrared coded data are not the same.

Further, the acquisition order of data in the infrared coded data is taken as a positive order, the comparing module is further configured to compare the two sets of infrared coded data bit by bit based on the positive order which starts from the starting positions of the two sets of infrared coded data; if different data is detected during the comparison between the two sets of infrared coded data based on the positive order, respectively recording the positions of the detected different data in the two sets of infrared coded data as first positions, and comparing the two sets of infrared coded data bit by bit based on the reverse order which starts from the termination positions of the two sets of infrared coded data; if no different data is detected during the comparison between the two sets of infrared coded data based on the reverse order until the first position in one set of infrared coded data with fewer bits, recording the former one position, which is in one set of infrared coded data with more bits, and is previous to the position where the comparison based on the reverse order is completed, as a second position, and detecting to determine whether the data between the first position and the second position in the set of infrared coded data with more bits is cyclic data; if the data is cyclic data, determining that the two sets of infrared coded data are the same, otherwise determining that the two sets of infrared coded data are different; if different data is detected during the comparison between the two sets of infrared coded data based on the reverse order until the first position in the set of infrared coded data with fewer bits, determining that the two sets of infrared coded data are different.

Judge whether the lengths of the two sets of infrared coded data are the same, if no different data is detected during the comparison between the two sets of infrared coded data based on the reverse order; if the lengths of the two sets of infrared coded data are the same, determining that the two sets of infrared coded data are the same; if the lengths of the two sets of infrared coded data are not the same, recording one latter position, which is in the set of infrared coded data with more bits, and is subsequent to the position where the comparison based on the positive order is completed, as the first position, and recording the termination position in the set of infrared coded data with more bits as the second position, and detecting to determine whether the data between the first position and the second position in the set of infrared coded data with more bits is cyclic data; if the data is cyclic data, determining that the two sets of infrared coded data are the same, otherwise determining that the two sets of infrared coded data are different.

Further, the infrared remote control learning device according to the present disclosure may further include a saving module 5, which saves the learned infrared coded data according to a saving instruction triggered by a user.

The implementation of each module in the infrared remote control learning device is the same as the operations in the above infrared remote control learning method, which will not be described in detail here.

The above is only the optional embodiment of the present disclosure and is not therefore limiting the scope of the patent of the present disclosure. Any equivalent structure or equivalent process change made by using the contents of the present specification and drawings, or directly or indirectly applied in other related technical fields, is similarly included in the scope of the patent protection of the present disclosure.

What is claimed is:

1. An infrared remote control learning method, comprising:

receiving an infrared signal transmitted by an infrared remote controller when a key of the infrared remote controller is operated;

acquiring corresponding infrared coded data according to the received infrared signal;

comparing every newly acquired subsequent infrared coded data with first acquired infrared coded data every time the subsequent infrared coded data is acquired;

returning to the operation of receiving an infrared signal transmitted by an infrared remote controller when a key of the infrared remote controller is operated, when the two sets of infrared coded data are different;

completing learning of the key, when the subsequent infrared coded data comprises infrared coded data that is identical to the first acquired infrared coded data, the subsequent infrared coded data being the infrared coded data acquired after the first infrared coded data;

wherein, when the acquisition order of data in the infrared coded data is taken as a positive order, the operation of comparing every newly acquired subsequent infrared coded data with first acquired infrared coded data every time the subsequent infrared coded data being acquired comprises:

comparing the two sets of infrared coded data bit by bit based on the positive order which starts from the starting positions of the two sets of infrared coded data;

if different data is detected during the comparison between the two sets of infrared coded data based on the positive order, respectively recording the positions of the detected different data in the two sets of infrared coded data as first positions, and comparing the two sets of infrared coded data bit by bit based on the reverse order which starts from the termination positions of the two sets of infrared coded data;

if no different data is detected during the comparison between the two sets of infrared coded data based on the reverse order until the first position in one set of infrared coded data with fewer bits, recording the former one position, which is in one set of infrared coded data with more bits, and is previous to the position where the comparison based on the reverse order is completed, as a second position, and detecting to determine whether the data between the first position and the second position in the set of infrared coded data with more bits is cyclic data; if the data is cyclic data, determining that the two sets of infrared coded data are the same, otherwise determining that the two sets of infrared coded data are different;

if different data is detected during the comparison between the two sets of infrared coded data based on the reverse order until the first position in the set of infrared coded data with fewer bits, determining that the two sets of infrared coded data are different;

subsequent to the operation of comparing the two sets of infrared coded data bit by bit based on the positive order which starts from the starting positions of the two sets of infrared coded data, the method further comprising:

if no different data is detected during the comparison between the two sets of infrared coded data based on the positive order, judging whether the lengths of the two sets of infrared coded data are the same; if the lengths of the two sets of infrared coded data are the same, determining that the two sets of infrared coded data are the same; if the lengths of the two sets of infrared coded data are not the same, recording one latter position, which is in the set of infrared coded data with more bits, and is subsequent to the position where the comparison based on the positive order is completed, as the first position, and recording the termination position in the set of infrared coded data with more bits as the second position, and detecting to determine whether the data between the first position and the second position in the set of infrared coded data with more bits is cyclic data;

if the data is cyclic data, determining that the two sets of infrared coded data are the same, otherwise determining that the two sets of infrared coded data are different.

2. The method according to claim 1, wherein after the operation of completing learning of the key, when the subsequent infrared coded data comprising infrared coded data that is identical to the first acquired infrared coded data, the method further comprises:

saving the learned infrared coded data according to a saving instruction triggered by a user.

3. An infrared remote control learning method, comprising:

receiving an infrared signal transmitted by an infrared remote controller when a key of the infrared remote controller is operated;

acquiring corresponding infrared coded data according to the received infrared signal;

comparing every newly acquired subsequent infrared coded data with first acquired infrared coded data every time the subsequent infrared coded data is acquired;

returning to the operation of receiving the infrared signal transmitted by an infrared remote controller when a key of the infrared remote controller is operated, when the two sets of infrared coded data are different;

completing learning of the key, when the subsequent infrared coded data comprises infrared coded data that is identical to the first acquired infrared coded data, and the subsequent infrared coded data being infrared coded data acquired after the first infrared coded data;

wherein, when the acquisition order of data in the infrared coded data is taken as a positive order, the operation of comparing every newly acquired subsequent infrared coded data with first acquired infrared coded data every time the subsequent infrared coded data being acquired comprises:

comparing the two sets of infrared coded data bit by bit based on the positive order which starts from the starting positions of the two sets of infrared coded data;

if different data is detected during the comparison between the two sets of infrared coded data based on the positive order, respectively recording the positions of the detected different data in the two sets of infrared coded data as first positions, and comparing the two sets of infrared coded data bit by bit based on the reverse order which starts from the termination positions of the two sets of infrared coded data;

if no different data is detected during the comparison between the two sets of infrared coded data based on the reverse order until the first position in one set of infrared coded data with fewer bits, recording the former one position, which is in one set of infrared coded data with more bits, and is previous to the position where the comparison based on the reverse order is completed, as a second position, and detecting to determine whether the data between the first position and the second position in the set of infrared coded data with more bits is cyclic data; if the data is cyclic data, determining that the two sets of infrared coded data are the same, otherwise determining that the two sets of infrared coded data are different;

if different data is detected during the comparison between the two sets of infrared coded data based on the reverse order until the first position in the set of infrared coded data with fewer bits, determining that the two sets of infrared coded data are different.

4. The method according to claim 3, wherein the operation of comparing the two sets of infrared coded data bit by bit based on the positive order which starts from the starting positions of the two sets of infrared coded data further comprises:

if no different data is detected during the comparison between the two sets of infrared coded data based on the positive order, judging whether the lengths of the two sets of infrared coded data are the same; if the lengths of the two sets of infrared coded data are the same, determining that the two sets of infrared coded data are the same; if the lengths of the two sets of infrared coded data are not the same, recording one latter position, which is in the set of infrared coded data with more bits, and is subsequent to the position where the comparison based on the positive order is completed, as the first position, and recording the termination position in the set of infrared coded data with more bits as the second position, and detecting to determine whether the data between the first position and the second position in the set of infrared coded data with more bits is cyclic data;

if the data is cyclic data, determining that the two sets of infrared coded data are the same, otherwise determining that the two sets of infrared coded data are different.

5. The method according to claim 3, wherein after the operation of completing learning of the key, when the subsequent infrared coded data comprising infrared coded data that is identical to the first acquired infrared coded data, the method further comprises:

saving the learned infrared coded data according to a saving instruction triggered by a user.

6. An infrared remote control learning device, comprising:

a receiving module, configured to receive infrared signal transmitted by an infrared remote controller when a key of the infrared remote controller is operated, a first acquiring module, configured to acquire corresponding infrared coded data according to the received infrared signal;

a completing module, configured to complete learning of the key, when the subsequent infrared coded data comprises infrared coded data that is identical to the first acquired infrared coded data, and the subsequent infrared coded data being infrared coded data acquired after the first infrared coded data;

a comparing module, configured to compare every newly acquired subsequent infrared coded data with first acquired infrared coded data every time the subsequent infrared coded data is acquired, and when the acquisition order of data in the infrared coded data is taken as a positive order, the comparing module being further configured to:

compare the two sets of infrared coded data bit by bit based on the positive order which starts from the starting positions of the two sets of infrared coded data;

if different data is detected during the comparison between the two sets of infrared coded data based on the positive order, respectively recording the positions of the detected different data in the two sets of infrared coded data as first positions, and comparing the two sets of infrared coded data bit by bit based on the reverse order which starts from the termination positions of the two sets of infrared coded data;

if no different data is detected during the comparison between the two sets of infrared coded data based on the reverse order until the first position in one set of infrared coded data with fewer bits, recording the former one position, which is in one set of infrared coded data with more bits, and is previous to the position where the comparison based on the reverse order is completed, as a second position, and detecting to determine whether the data between the first position and the second position in the set of infrared coded data with more bits is cyclic data; if the data is cyclic data, determining that the two sets of infrared coded data are the same, otherwise determining that the two sets of infrared coded data are different;

if different data is detected during the comparison between the two sets of infrared coded data based on the reverse order until the first position in the set of infrared coded data with fewer bits, determining that the two sets of infrared coded data are different;

the receiving module being further configured to receive an infrared signal transmitted by an infrared remote controller when a key of the infrared remote controller is operated, when the two sets of infrared coded data are different.

7. The device according to claim 6, wherein the comparing module is further configured to:

judge whether the lengths of the two sets of infrared coded data are the same, if no different data is detected during the comparison between the two sets of infrared coded data based on the positive order;

if the lengths of the two sets of infrared coded data are the same, determining that the two sets of infrared coded data are the same;

if the lengths of the two sets of infrared coded data are not the same, recording one latter position, which is in the set of infrared coded data with more bits, and is subsequent to the position where the comparison based on the positive order is completed, as the first position, and recording the termination position in the set of infrared coded data with more bits as the second position, and detecting to determine whether the data between the first position and the second position in the set of infrared coded data with more bits is cyclic data;

if the data is cyclic data, determining that the two sets of infrared coded data are the same, otherwise determining that the two sets of infrared coded data are different.

8. The device according to claim 6, further comprising:

a saving module, configured to save the learned infrared coded data according to a saving instruction triggered by a user.

* * * * *